US005184103A

United States Patent [19]

Gadreau et al.

[11] Patent Number: 5,184,103

[45] Date of Patent: Feb. 2, 1993

[54] HIGH COUPLING TRANSFORMER ADAPTED TO A CHOPPING SUPPLY CIRCUIT

[75] Inventors: Jean Gadreau, Echirolles; Andre Pascal, St. Joseph de Riviere, both of France

[73] Assignee: Bull, S.A., Paris, France

[21] Appl. No.: 649,181

[22] PCT Filed: May 10, 1988

[86] PCT No.: PCT/FR88/00229

§ 371 Date: Jan. 17, 1989

§ 102(e) Date: Jan. 17, 1989

[87] PCT Pub. No.: WO88/09042

PCT Pub. Date: Nov. 17, 1988

Related U.S. Application Data

[63] Continuation of Ser. No. 314,065, Jan. 17, 1989, abandoned.

[30] Foreign Application Priority Data

May 15, 1987 [FR] France ..... 87 06835

[51] Int. Cl.[5] ..... H01F 15/04; H01F 27/30

[52] U.S. Cl. ..... 336/84 C; 336/180; 336/183; 336/200; 336/232

[58] Field of Search ..... 336/84 C, 84 R, 180, 336/182, 183, 200, 232

[56] References Cited

U.S. PATENT DOCUMENTS

| | | | |
|---|---|---|---|
| 3,419,834 | 12/1968 | McKechnie et al. | 336/232 X |
| 3,483,499 | 12/1969 | Lugten | 336/232 X |
| 3,833,872 | 9/1974 | Marcus et al. | 336/83 |
| 4,012,703 | 3/1977 | Chamberlayne | 336/200 X |
| 4,201,965 | 5/1980 | Onyshkevych | 336/200 X |
| 4,547,961 | 10/1985 | Bokil et al. | 336/200 X |
| 4,937,729 | 6/1990 | Gadreau et al. | 363/134 |

FOREIGN PATENT DOCUMENTS

| | | | |
|---|---|---|---|
| 2409881 | 4/1975 | Fed. Rep. of Germany | 336/83 |
| 981390 | 12/1948 | France . | |
| 1580316 | 5/1968 | France . | |

OTHER PUBLICATIONS

Abstract of Japanese Patent publication, vol. 10 No. 108 (E-398) (2165) Apr. 23, 1986.

*Primary Examiner*—Thomas J. Kozma

*Attorney, Agent, or Firm*—Lowe, Price, LeBlanc & Becker

[57] ABSTRACT

Turns of primary and secondary windings of a chopper power supply transformer are formed by magnetically coupled stacked parallel planar printed circuit conducting layers. The primary winding is between first and second parts of the secondary winding that are connected in series and parallel. Layers at opposite ends of the primary winding are (i) arranged to reduce leakage currents between the secondary winding parts and (ii) positioned between further layers of the primary winding and the secondary winding. Terminals of the first and second layers are connected together as a first input terminal of the transformer. Other terminals of the first and second layers have a common connection. Further layers of the primary winding are connected in series with each other between the common connection and a second input terminal of the transformer. A primary winding shield turn, positioned between a turn of the secondary winding in closest proximity thereto and all other turns of the primary winding, includes an exterior segment for conducting current supplied to the transformer between terminals of the layer forming the shield turn and an interior conducting portion directly connected to the exterior portion. The interior and exterior portions have approximately the same DC potential. A direct connection subsists between the interior portion and one terminal of the shield turn layer. The interior portion is proximate a magnetic core and forms an electrostatic shield for currents having a tendency to flow between the windings.

40 Claims, 6 Drawing Sheets

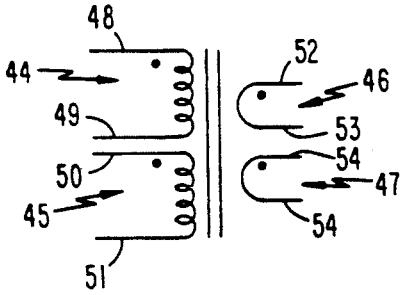
FIG. 7
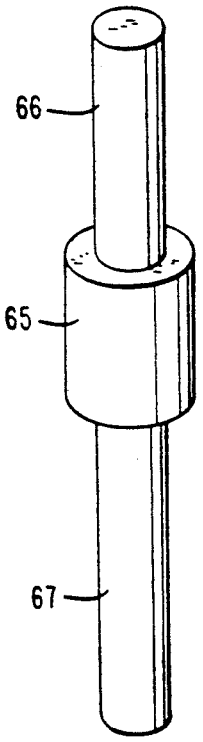
FIG. 9
FIG. 10
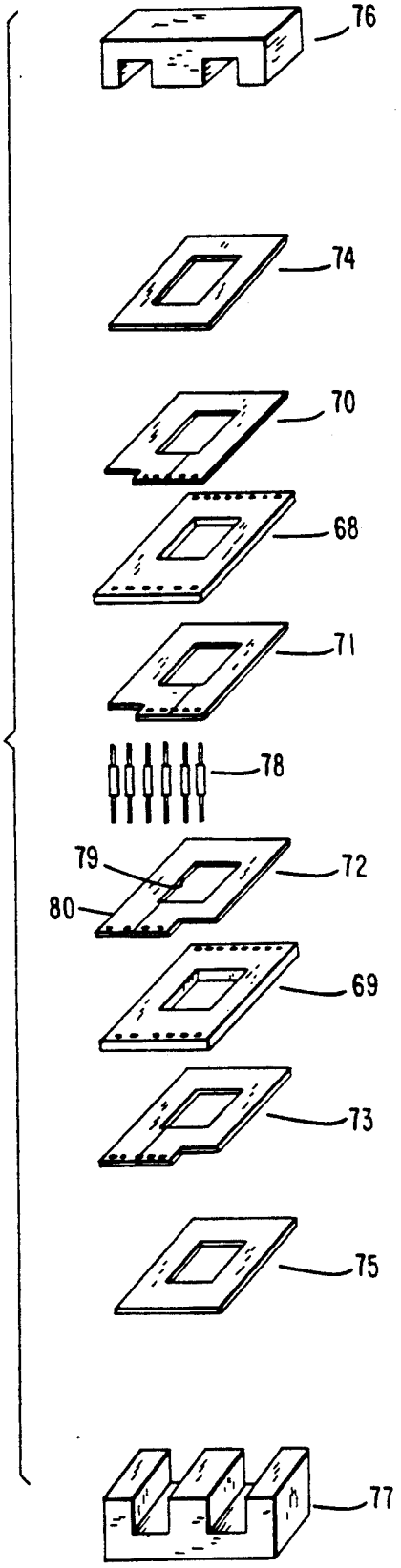

HIGH COUPLING TRANSFORMER ADAPTED TO A CHOPPING SUPPLY CIRCUIT

This application is a continuation of application Ser. No. 07/314,065 filed Jan. 17, 1989 now abandoned.

The present invention relates to a transformer having a high degree of coupling adapted for use with a chopper supply circuit. It also relates to a chopper supply circuit employing such a transformer.

The invention pertains to technology concerned with manufacturing and optimizing multi-layer transformers.

The invention enables electrical and mechanical characteristics to be reproduced for mass reproduction, while minimizing manufacturing controls and waste.

In multi-layer technology, a transformer includes primary and secondary circuits magnetically coupled to each other by way of a magnetic circuit; these two circuits are formed by stacking printed layer turns formed as an almost-closed conducting rail.

One variant, according to the invention, enables a transformer to deliver large currents by interleaving a multi-layer printed circuit with cut metal turns; these cut metal turns have a thickness greater than that of the printed layers.

The invention permits a transformer having a very high degree of coupling to be achieved. The invention is particularly adapted for use with a chopper supply circuit which drives the windings with currents having very high frequency variations.

The transformer according to the invention is intended to be mounted in chopper supplies having dimensions as small as possible. The transformer, according to the invention, is formed as flat as possible.

In order for the apparatus to develop a predetermined level of electric power in a minimum volume, it is desirable to provide a structure that is thermally optimized. A low thermal grading between the interior and exterior of the transformer is sought. By dividing the stacked layers into N printed circuit boards, the thermal exchange surface increases by a factor N.

Finally, to reduce parasitic coupling, the transformer of the present invention is electrically optimized to minimize primary-secondary parasitic current.

To remedy the many non-resolved problems of the prior art, the present invention concerns a multi-layered transformer having a high degree of coupling. The invention is characterized particularly by the fact that two adjacent turns are at potentials as close to each other as possible. The potentials of two immediately adjacent turns of the primary and secondary are as fixed as possible. The turns most remote from the turns having the fixed potential are at variable potentials relative to the fixed potential.

Figure 1:
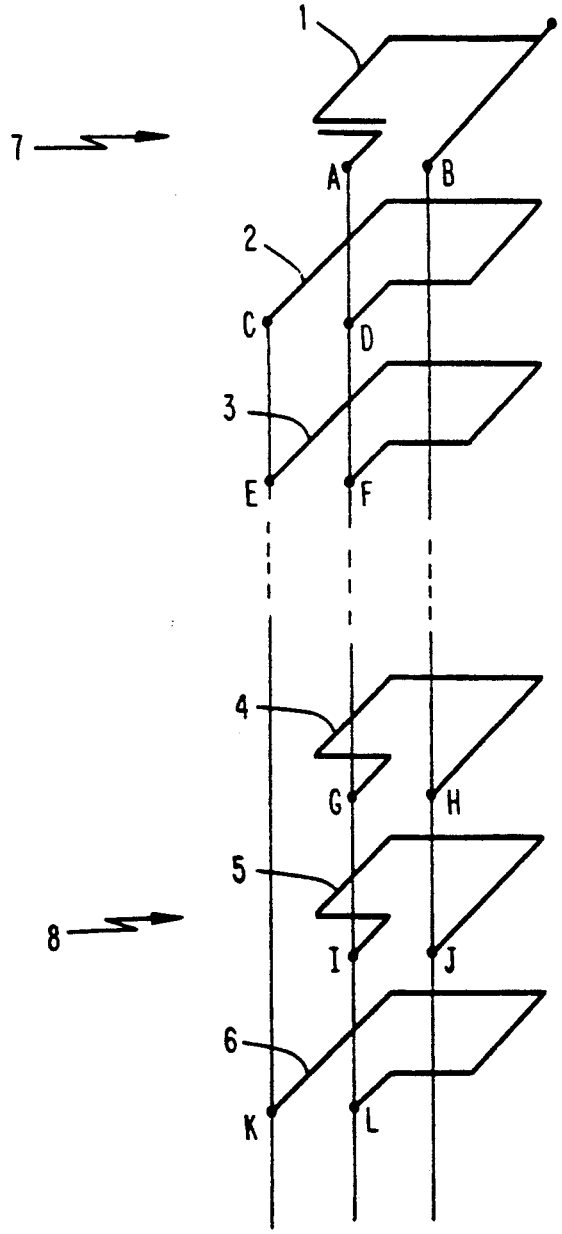

Other characteristics and advantages of the present invention will appear more clearly in the description of the attached figure wherein:

FIG. 1: a diagram of a connection of secondary turns in a transformer according to the invention.

Figure 2:
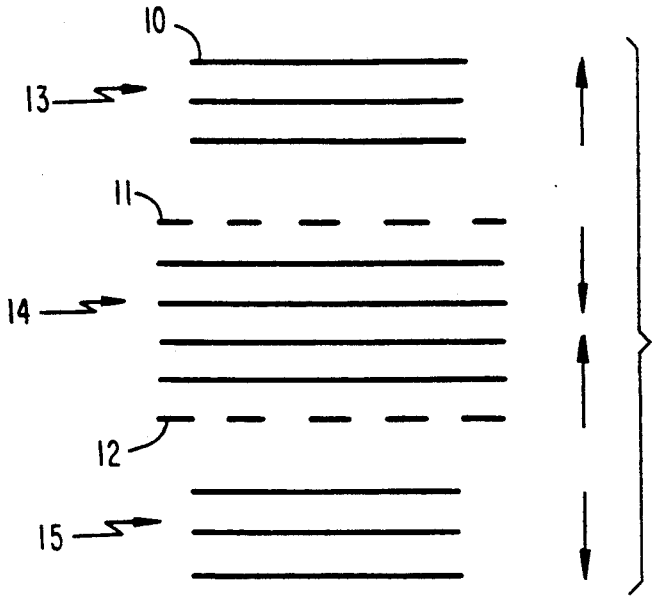
Figure 3:
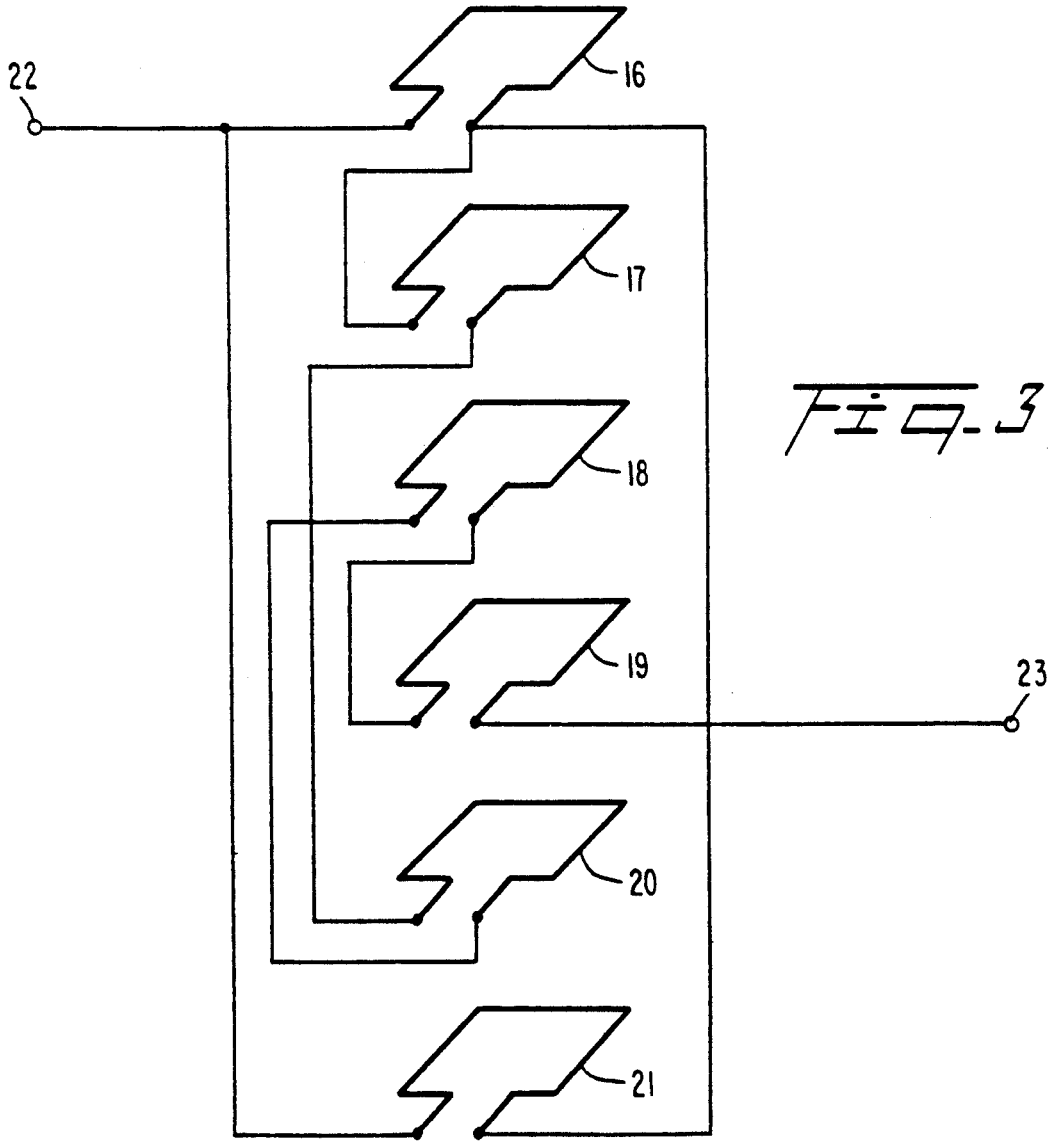
Figure 4A:
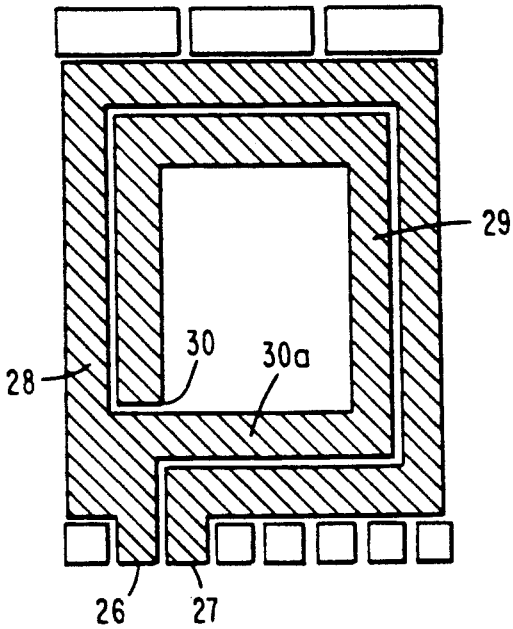
Figure 4B:
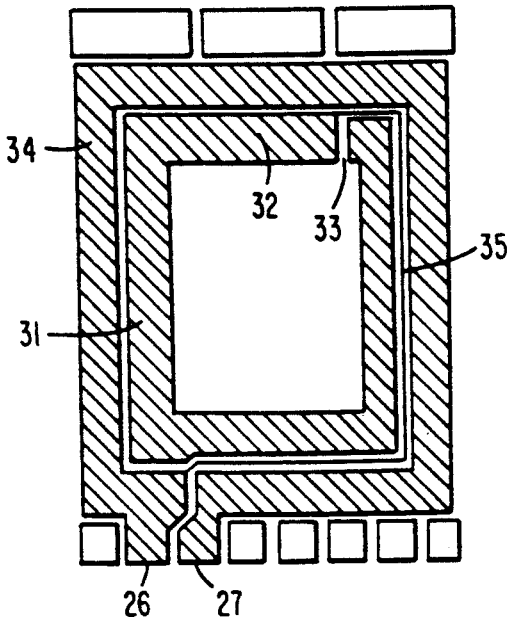
Figure 4C:
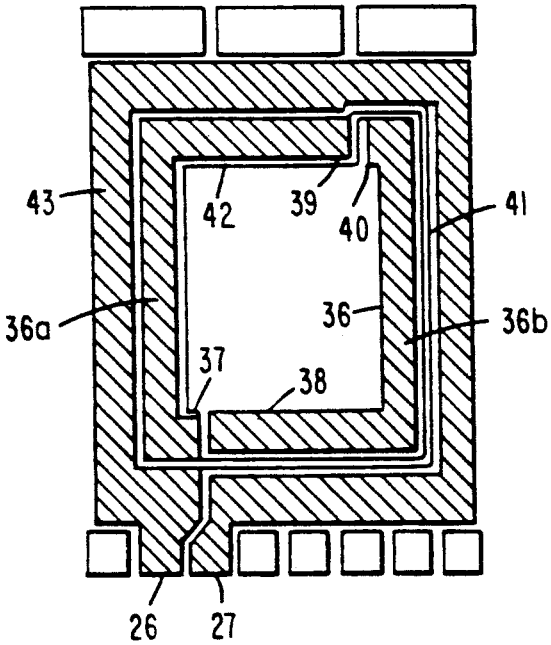
Figure 4D:
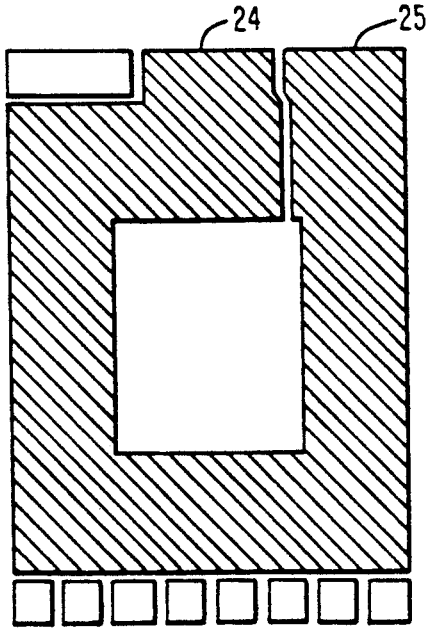
Figure 5:
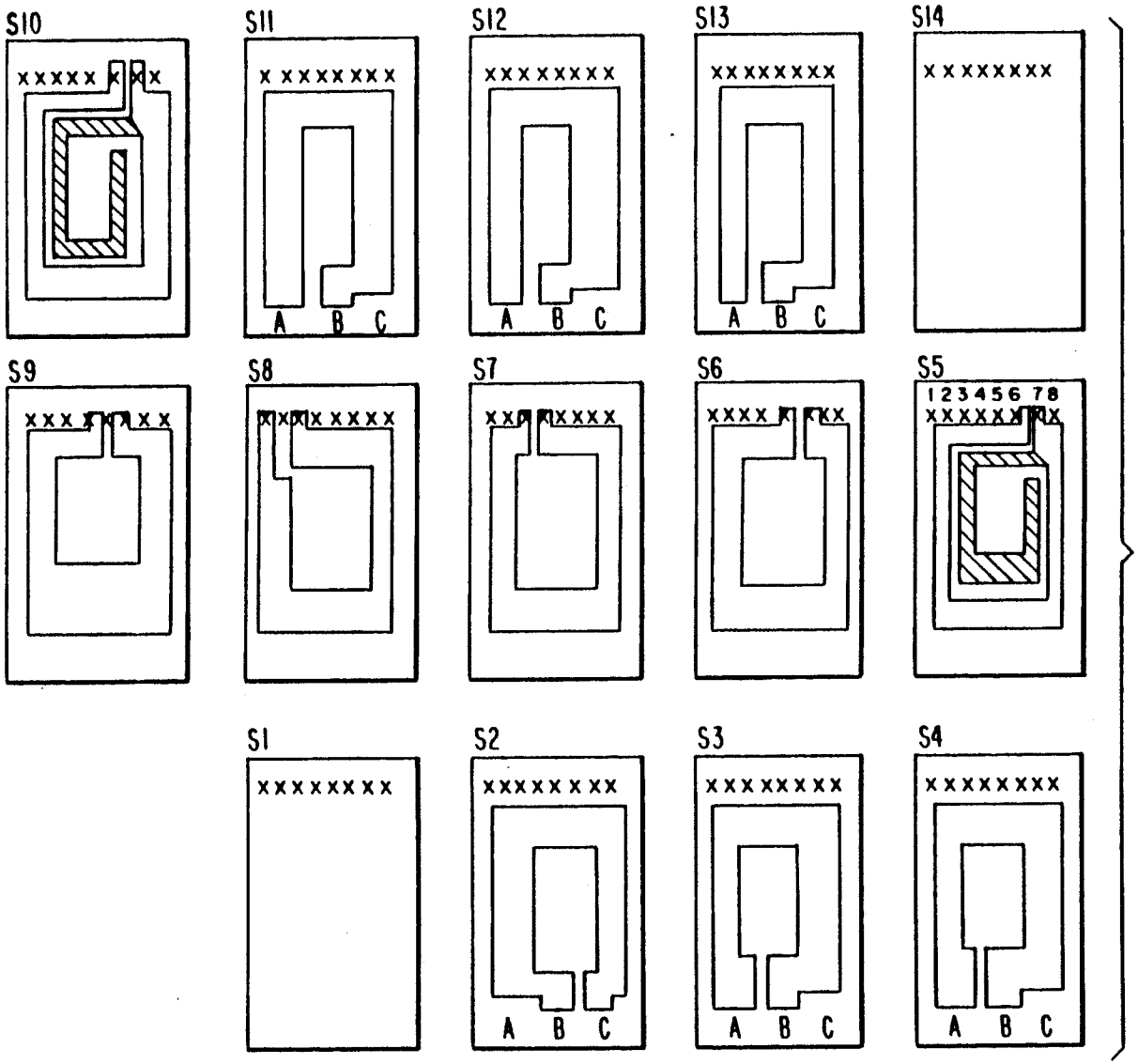
Figure 6:
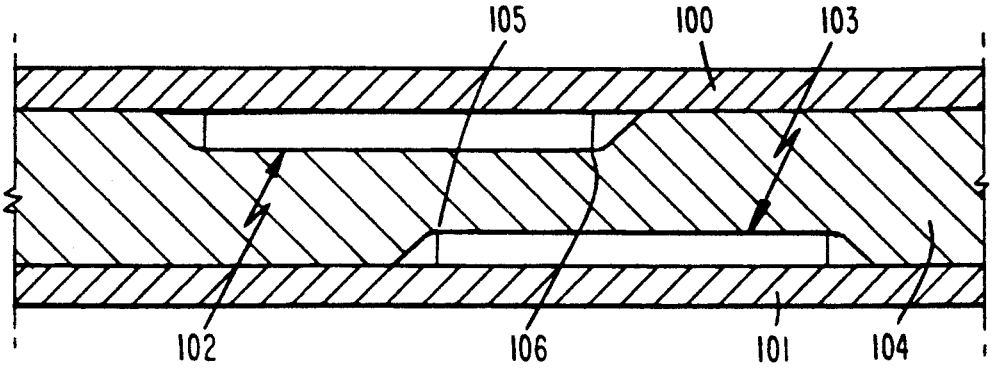
Figure 8:
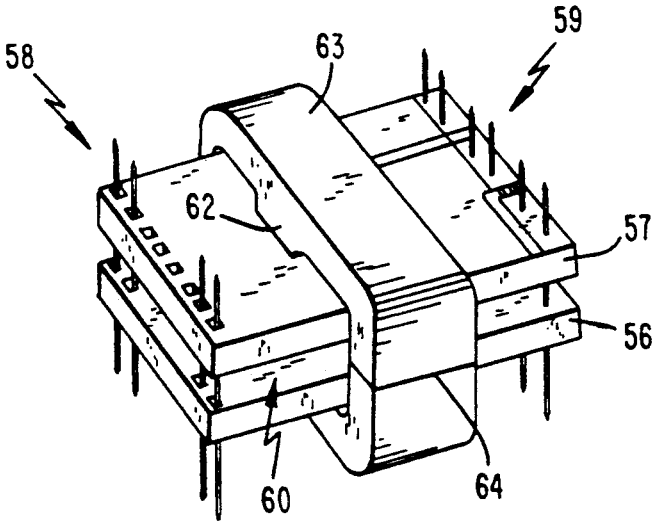

FIG. 2: a diagram indicating how the turns in a transformer according to the invention are stacked, FIG. 3: a connection diagram of the turns of the primary of a transformer according to the invention, FIGS. 4*a*–4*d*: three embodiments of a special turn arranged between the primary and secondary of a transformer, according to the invention, FIG. 5: a diagram indicating how fourteen layers are stacked to form a half-winding, FIG. 6: a design showing how insulators are used to provide optimization, FIG. 7: an electrical diagram of a possible design, FIG. 8: a transformer according to the invention.

FIG. 9: a terminal hub,

FIG. 10: a drawing indicating how the printed circuits and the cut metal turns are stacked.

In FIG. 1 is illustrated a diagram for the connection of secondary turns of a transformer, illustrated in FIG. 7 as including half primary windings 44 and 45, as well as half secondary windings 46 and 47. Each half secondary winding 46, 47 includes two identical parts, each comprising an odd number of turns. To reduce leakage caused by separating the two parts of a half-secondary, each a half secondary turn of one part is connected to terminals of a corresponding turn of the other part. Schematically, turns (1), (2) and (3) of half-secondary part (7) contain terminals A, B, C, D, E, F. The other half-secondary part (8) includes turns (4), (5) and (6) having successive terminals G, H, I, J, K, L, respectively. The terminals are connected in such a way that turn (1) corresponds to turns (4) and (5) and turns (2) and (3) correspond to turn (6). Therefore, connections ADFGIL, CEK and BHJ are established. In the embodiments of the invention wherein the half-secondary contains a greater number of turns, this arrangement is repeated as many times as necessary.

In FIG. 2, a half-transformer, in accordance with the invention, is illustrated. According to the invention, a half-transformer includes a stack of distributed turns between half-primary (14) and a half-secondary that is illustrated in FIG. 2 as being divided into two parts (13) and (15), which surround the half-primary. Parts (13) and (15) correspond with parts (7) and (8), respectively. The half-secondary is preferably as illustrated in FIG. 1.

One part (13) of the half-secondary is separated from the half-primary (14) by a special turn (11) that forms a shield. The second part (15) of the half-secondary is spaced from the half-primary (14) by a second special turn (12) forming an electrostatic shield. On the right side of FIG. 2, the direction of the voltage variations of the turns of the half-primary and of the half-secondary that is divided into two parts is indicated. The arrow head indicates a variable voltage that changes polarity, while the other end of the arrow represents a fixed voltage.

To reduce the potential variations between each half-primary and half-secondary, the turns are connected in such a way that the potential between different parts of the special screen turns (11) and (12) is fixed as much as possible and the turns of half-primary (14) in proximity to the interior of the half-transformer are at potentials that vary to the greatest extent.

In FIG. 3, there is an illustration of a primary formed by stacking six turns. Exterior turns (16) and (21) form an electrostatic screen. These two turns are connected to each other in parallel. Active turns (17), (18), (19), (20) are connected in such a way that the voltages are as fixed as possible on the external surfaces of the stack. At the ends of the stack, the output of turn (17) is connected to the input of turn (20) having an output connected to the input of turn (18). The output of turn (18) is connected to the input of turn (19), having an output at the variable potential to form terminal (23) of the half-primary.

To represent, in a formal manner, the case of a primary having 2P turns (the turns being numbered successively by the stacking order from 1 to 2P), not including the two-turn shield, consider the situation of a series of connected turn pairs, connected in series with each other. The first pair is formed by series turn K and by series turns 2P−K+1, such that the last pair is formed by connecting turn P in series with turn P+1.

Thus, the electrical connection of two turns having order K is noted as (K, 2P−K+1). This is represented in FIG. 3 as 2P=4 and K=1 for the turn pair 17, 20 and K=2, for the turn pair 18, 19. The formula to implement P series pairs is:

$$\sum_{K=1}^{K=P} (K, 2P - K + 1)$$

Each turn pair includes an input on turn K and output on turn 2P−K+1. The implementation of a series of two pairs in the example of FIG. 3 is represented by the output of pair K to the input of pair K+1.

Such a distribution of voltages enables capacitive leakage currents—produced by the voltages between adjacent turns—between the primary and secondary to have a minimum value.

In FIG. 4, there are illustrated three embodiments in FIGS. 4*a*, 4*b* and 4*c* of a special turn that is in closest proximity to a secondary turn, with the turn illustrated in FIG. 4*a* being a turn in a half-primary. These turns, which form an electrostatic shield, are illustrated as turns (16) and (21) in FIG. 3, or as turns (11) and (12) in FIG. 2. The three embodiments provide different efficiencies and complexities to minimize primary-secondary parasitic current due to chopping effects, when the transformer is part of a chopper supply. To provide maximum effectiveness, the adjacent secondary turn illustrated in FIG. 4*d* includes two terminals (24) and (25) diametrically opposed to terminals (26) and (27) of the special turn, as illustrated in the embodiments of FIGS. 4*a*, 4*b*, 4*c*.

The active turn of the secondary, adjacent the shield turn and represented in FIG. 4*d*, includes a large, partially closed conducting rail having a central window. The central window allows the printed circuit to be stacked on a leg of a magnetic circuit. The turn is cut so that input terminal 24 is spaced from output terminal 25. The cut is preferentially formed to include two angles so that there is an increase in electrical resistance in the radial direction of the cut. The cut is generally formed by at least two non-aligned rectilinearly extending linear segments.

The turn of the special turn connected to terminal (26) and terminal (24) of the adjacent secondary turn are at approximately the same fixed potential, but are decoupled from each other by a condenser having an appropriate value for the chopping frequency when the transformer is part of a chopper supply.

According to the embodiment illustrated in FIG. 4, such a turn includes two oppositely directed parts. Terminal (26) of exterior turn (28) is located at a fixed potential having a value as close as possible to that of the following turn. At the interior of a ring formed by this turn, there is provided an inverted second turn (29) having a terminal connected to terminal (26) of exterior turn (28), the other end (30) is left free.

The two turns are arranged as close as possible to each other. The exterior turn (28), having terminals (26) and (27) is, in actuality, the first turn of the primary winding. It is, therefore, an active turn of the transformer.

The electric distance along the circuit between the special turn and the adjacent secondary turn tends to decrease the primary-secondary parasitic current due to chopping.

This first embodiment is well adapted to be used in small transformers; it has average efficiency.

According to a second embodiment of the invention, illustrated in FIG. 4*b*, interior turn (31) includes terminals (32) and (33) diametrically opposed to terminals (26) and (27) of active turn (34). Terminal (32) of interior turn (31) is connected to terminal (26) of the active turn by strap (35). Extremity (33) is left free. As in the first embodiment, the two turns must be as close as possible. Strap (35) must be as narrow as possible. This embodiment has a greater efficiency than the first embodiment and is suitable for transformers having average power.

According to a third embodiment illustrated in FIG. 4*c*, interior turn (36) is divided into two identical parts (36*a*) and (36*b*). Terminals (37), (38) are opposite to each other and diametrically opposed to facing terminals (39), (40). Terminal (39) of interior half-turn (36*a*) is connected to terminal (26) of active turn (43) by strap (41), while the other terminal (37) of this half-turn is connected to terminal (38) of a second half-turn (26*b*) by strap (42). Terminal (40) of the second half-turn (36*b*) is left free. The active turn and the two interior half-turns must be as close to each other as possible, with straps (41) and (42) as narrow as possible. Strap (41) is not a direct connection that removes the effect of a break of internal turn (36). It is formed by a narrow rail making a complete revolution around the common central region of internal turn (36) and external turn (43). This embodiment has the greatest efficiency; it is suitable for high-power transformers.

To form a transformer according to the invention, two printed circuits, each including 14 engraved layers carrying connections contacts are stacked on each other so that there is a central window and an almost closed path to form a turn on each engraved layer.

In FIG. 5, a series of 14 printed circuit layers for forming a half transformer in accordance with the invention is illustrated. The 14 plates have identical dimensions and contain, on the lower part of each, six metallized openings (each shown in FIG. 5 and illustrated for a stacked configuration in FIG. 8 by the vertically extending leads on the right side of FIG. 1), assembled two-by-two to establish connections ADFGIL, CEK, BHS in FIG. 1 for the turns of the two parts of the half-secondary that transforms the illustrated half transformer. In the upper part of each printed circuit are located eight contacts, each including a metallized hole, numbered from 1 to 8 (on plate S5 and shown on plates S1–S16 as X's at the top of each), on the plates using them. Thus, the connections of the turns of the illustrated half-secondary are provided on the lower part of the printed circuit, as shown by regions A, B, C, while the connections of the half primary are provided in the upper part of the printed circuit as shown by the X's. Connections between the printed plates take place, by way of the metallized holes. The plates are successively numbered from S1 to S14 by the order in which they are stacked in the half transformer. The first plate S1 and the last plate S14 provide mechanical and electrical protection for the stack. The half-secondary, which is divided into two parts that surround the half-primary, includes, in the first part, that corresponds with part 7, FIG. 1, or part 13, FIG. 2, plates S2, S3, S4 and plates S11, S12, S13 in the other part which corresponds with part 8, FIG. 1, or part 14, FIG. 2. The half-secondary is formed by connecting turn S2 in series with parallel connections of turns S3, S4, S11, S12 and S13.

The half-primary is formed by stacking six plates S5 to S10. Outer plates S5 and S10 are opposite to the two parts of the half-secondary. Electrostatic protection is provided by the shaded portions of plates S5 and S10, which constitute a turn having half the size represented.

This turn is wound in an opposite direction from the active turn on half of the area of the plate in question. The plates of the half-primary are connected to each other by connectors including the metallized holes, of which there are eight on each plate. These metallized holes are numbered from left to right, as 1 to 8, with the numbers for each plate indicated in the diagram. Thus, one part of the half-primary winding is formed by connecting turns S5, S6, S9, S7 and S8 in series, while the other part is formed by connecting turns S5 and S10 in parallel. Finally, the input terminals of the half-primary corresponding with terminals 22 and 23, FIG. 3, are formed by terminal 7 on plate S5 (corresponding with turn 16, FIG. 3), that is at a fixed potential, and terminal 1 on plate S8 (corresponding with turn 19, FIG. 3), that is at a variable potential.

Terminals 2 and 8, represented on plate S5, are not connected. When two printed circuits are connected, linkages between them are simplified. Because the connections in a series of half-primary turns is completely accessible (via terminals 1-3-4-5-6-7), one can easily modify production of the transformer.

In FIG. 6 are illustrated two of the 14 layers of the printed circuit, denominated (100) and (101). Engraved copper layers (102) and (103) are opposite each other and isolated from each other by a prepreg (104). The copper design was optimized such that two edges, for example, (105) and (106), are never aligned. This arrangement enables the thickness of the insulator to be decreased, while avoiding the risks of cutting it outside of pressing of the printed circuit. The transformer thickness between the primary and secondary is enhanced.

In FIG. 7, there is an electrical diagram of a transformer, according to the invention. The half-primary (44) or (45) is associated with half-secondary (46) or (47) in a printed circuit having the configuration described for FIG. 5. The example shows how two printed circuits can be associated to provide a transformer wired for push-pull. Common terminals (49) and (50) or (53) and (54) are connected at a point of the primary or secondary at fixed potential. Terminals (48) and (51) or (52) and (55) are connected at a point of the primary or secondary having variable potential. Phase agreement is represented by four terminals. The capability of connecting the turns in series or parallel offers a great number of possible combinations, as well as a transformer that is adapted to be connected in a module.

In FIG. 8, a complete transformer fulfilling the described functions in the diagram of FIG. 7 is illustrated. Two identical layers (56) and (57), each comprising a half-primary and a half-secondary, are connected by two rows of leads (58) and (59). One layer is mounted with its outer side toward the top, with the other layer being directed toward the bottom. In this way, the two half-secondaries are opposite to each other. An empty region (60) between the two layers of printed circuits (56) and (57) provides improved cooling by enabling a cooling fluid to circulate therein. The dimension of this region varies as a function of the flow rate and the nature of the coolant available to optimize cooling. Finally, the transformer includes a magnetic circuit (61) having a central portion (62) which descends into central windows of the two layers. In the preferred embodiment, the magnetic circuit includes central portion (62) that is mounted in the middle of closed part (63). The assembly is divided by median plane (64) to facilitate assemblage.

In FIG. 9 is illustrated the design of a terminal hub. This part fulfills three functions:

the height of cylinder (65) enables the separation between the two printed circuit layers to be fixed to provide for passage of cooling fluid;

cylinder (66) extends out of the layer of the outer printed circuits by way of a hole in the terminal to provide increased cooling while it removes dissipated heat energy from the core of the printed circuit into the surrounding outside region;

cylinder (67), which forms a connection with a corresponding terminal of the lowest layer, has sufficient height to provide a junction on the printed circuit which constitutes the supply when it is mounted on the printed circuit.

In FIG. 10, there are two printed circuit stacks (68) and (69), as previously described, each comprising a half-primary and half-secondary, both providing substantial chopping.

To increase the available current to the secondary, cut metal turns (70), (71), (72), (73) having a greater thickness than a layer of the printed circuits are added. The strong chopping effect is preserved because of the secondary turns included in printed circuit (68) and (69). Insulating parts (74) and (75) enable cut turns (76) and (77) closest to the magnetic circuit to be relatively isolated from each other.

The isolation between printed circuits (68) and (69) and cut turns (70)-(73) is assured by the closing layer of the printed circuits.

Terminal hubs (78), as described in FIG. 9, assure the relative positioning of cut turns (70)-(73). The size of the interior cuts (or windows) (79) and the exteriors (80) of layers (68)-(74) is determined so that the magnetic circuit is spaced from the passage.

Stacked layers (68) and (69) are all identical and can be mounted in two possible directions according to the configuration imposed by the electric circuit diagram.

We claim:

1. A transformer adapted to be connected in a chopper power supply driven by a DC source having a terminal, the supply including a switching transistor having an electrode, the transformer comprising a primary winding and a secondary winding having first and second parts on opposite sides of the primary winding, each part of said secondary winding having turns connected in series and parallel, each of said windings including plural turns, individual ones of said turns being formed by a printed circuit electrically conducting layer, said layers being (i) magnetically coupled to each other, (ii) stacked in mutually parallel planes, and (iii) connected to each other so that:

(a) terminals of first and second of said layers respectively forming closest adjacent turns in the stack of the primary and secondary windings have approximately fixed potentials while the primary winding is connected to the terminal of the DC source and (b) third and fourth of said layers respectively forming most remote turns in the stack of primary and secondary windings have potentials that vary relative to the fixed potential to a greater extent than any other turns in the stack while the primary winding is connected to the terminal of the DC source and the electrode of the switching transistor.

2. The transformer of claim 1 wherein the secondary winding first and second parts have the same number of turns.

3. The transformer of claim 2 wherein the first part of the secondary winding includes a first turn connected in parellel with turns of the second part of the secondary winding and the second part of the secondary winding includes a second turn connected in parallel with turns of the first part of the secondary winding to reduce leakage currents caused by the separation between the parts of the secondary winding relative to the leakage currents that would flow between the parts of the secondary windings without said first and second turns.

4. The transformer of claim 2 wherein the transformer includes first and second segments, each of said transformer segments including said primary winding surrounded by said first and second parts of said secondary winding forming a half-primary winding and a half-secondary winding, adjacent turns of each half-primary and of each half-secondary being spaced by a turn forming an electrostatic screen, the potentials of the turns of the primary winding being coupled to said parts of the secondary winding via said turns forming the screens.

5. The transformer of claim 4 wherein the turns forming the screens are connected in parallel, said primary winding including 2P active turns traversed by current supplied to the primary winding, the active turns being connected in series and having the same winding direction, the active turns being arranged in pairs as turns 1, 2, . . . i, . . . P, P+1, . . . 2P−i+1 . . . 2P, the active turns i and 2P−i+1 being connected in series so that P series of two turns are connected in accordance with $$\sum_{i=1}^{i=P} (i.\ 2P - i + 1)$$

the current being supplied to the (i+1)th turn being responsive to current flowing from series i.

6. The transformer of claim 4 wherein the secondary turn adjacent the turn formed as a screen includes an elongated, partially closed electrically conducting rail having terminals located on a side of the secondary turn side on which are located terminals of the turn formed as a screen.

7. The transformer of claim 6 wherein the secondary turn adjacent the turn forming the screen is formed by a cut of an initially closed track, the cut including first and second non-aligned rectilinear parts.

8. The transformer of claim 4 wherein the turn forming the screen includes concentric partially closed, closely spaced first and second turns directed in opposite directions to each other.

9. The transformer of claim 8 wherien one of said concentric turns is an interior turn and another of said concentric turns is an exterior turn, the interior turn including a first free end and a second end connected as close as possible to a terminal of the external turn, the external turn being at a fixed potential having a value that is approximately equal to that of the immediately adjacent turn.

10. The transformer of claim 9 wherein the full width of the seocnd end of the interior turn is connected to the external turn near the terminal having a fixed potential.

11. The transformer of claim 9 wherein the ends of the interior turn face a side opposite to a pair of terminals of the external turn, the potential of the fixed terminal being supplied to the end of the internal turn by a thin electrically conducting lead extending between a pair of segments of the internal turn and the external turn such that electrical currents flow in opposite directions in the two turns.

12. The transformer of claim 11 wherein the interior turn is divided into first and second parts spaced from each other at a position aligned with the terminals of the external turn, the first part including the free end and a second end formed at a gap between the first and second parts, the second part being electrically connected to a corresponding end of the second part by a narrow lead making a complete revolution around a central common region of the interior and exterior turns.

13. The transformer of claim 4 further including two identical printed circuit stacks, each of said stacks including said half-primary surrounded by said parts of said half-secondary, the turns forming the screens being between each half-primary and eahc half-secondary winding part, each printed circuit in the stack including terminals having connections with the secondary turn windings on a first side of the printed circuits, and the terminals having connections with the primary turns being on a second side of the printed circuits, each of the terminals being connected with a connector for joining two turns on two printed circuits, the connector extending perpendicular to planes in which the turns are located when the connector is bonded to the terminal.

14. The transformer of claim 13 wherein the turns include matal layers on opposite sides of a dielectric board, said layers having edges arranged to that they are never aligned to increase cutting between the primary and secondary windings and reduce the thickness of the board while avoiding the risks of cutting the board outside of the pressing of the printed circuit.

15. The transformer of claim 14 further including a magnetic core having two symmetrical halves relative to a median plane of the transformer, the core including a central leg around which are stratified different winding layers of the transformer, said windings being divided into first and second assemblies on opposite sides of the median plane, said first and second assemblies being arranged so that an open region subsists between them, said open region having a height determined as a function of a cooling fluid flowing through the open region, electrical connectors extending between said assemblies connecting printed circuits in the assemblies together, the connectors including a central cylinder having parallel faces, the assemblies having parallel faces abutting against the parallel faces of the cylinder.

16. A transformer comprising a primary winding, and a secondary winding including first and second similar spaced parts, each of said windings including plural turns, individual ones of said turns being formed by a printed circuit electrically conducting layer, said layers being (i) magnetically coupled to each other and (ii) stacked in mutually parallel planes so that the layers of the primary winding are between the layers of the first and second parts of the secondary winding each part of said secondary winding having turns connected in series and parallel, first and second of said layers at opposite ends of the primary winding being connected and configured to reduce leakage currents between the spaced parts of the secondary winding relative to the leakage current that would flow between the spaced parts of the secondary winding without said first and second layers being present and being positioned between further layers of the primary winding and the layers of the secondary winding, one terminal of said first and second layers being connected together as a first input terminal of the transformer, a second terminal of said first and second layers having a common connection, further layers of the primary winding being connected in series with each other between the common connection of the second terminals and a second input terminal of the transformer.

17. The transformer of claim 16 wherein the further layers of the primary winding are divided into first and second approximately identical segments on opposite sides of a central plane of the stack, the layers in the first segment being connected to each other via the layers in the second segment, the layers in the second segment being connected to each other via the layers in the first segment.

18. The transformer of claim 17 wherein the first and second layers are respectively in the first and second segments, the first layer being connected to a third layer in the second segment via a connection between the third layer and a fourth layer in the first segment.

19. The transformer of claim 16 wherein the layers of the secondary winding are arranged to include aligned terminals in the stack, first terminals for all layers of the secondary winding in the stack being aligned, the first and second parts of the secondary winding including N layers, each of P layers of the first part including a second terminal, each of Q layers of the first part including a third terminal, each of Q layers of the second part including a second terminal, each of P layers of the second part including a third terminal, where $(P+Q)=N$ and $(P+1)=Q$, said second and third terminals being located on opposite sides of the first terminal, said second terminals being substantially aligned, said third terminals being substantially aligned, said first terminals being connected to each other and a first transformer output terminal, said second terminals being connected to each other and to a second transformer output terminal.

20. The transformer of claim 19 wherein one of the P layers in the first part of the stack is farther from the primary winding than any of the other P layers and than any of the Q layers in the first part of the stack, one of the P layers in the second part of the stack is closer to the primary winding than any of the other P layers and than any of the Q layers in the second part of the stack, one of the Q layers in the second part of the stack is farther from the primary winding than any of the other Q layers and than any of the P layers in the second part of the stack, one of the Q layers in the first part of the stack is closer to the primary winding than any of the other Q layers and than any of the P layers in the first part of the stack.

21. The transformer of claim 16 wherein each of the layers includes a pair of closely spaced terminals and an almost closed circular-like path for conducting current between said terminals.

22. The transformer of claim 21 wherein the terminals of the primary and secondary windings are respectively oppositely disposed relative to each other.

23. The transformer of claim 16 wherein each of the layers includes a pair of terminals and a circular-like path for conducting current between said terminals of said layer, each of said paths being arranged so an opening is in the center thereof, said openings being aligned in the stack, and magnetic core means extending through the openings for magnetically coupling the windings together.

24. The transformer of claim 23 wherein each of the first and second layers at opposite ends of the primary winding includes: an exterior segment for conducting current between the terminals of said layer and an interior electrically conducting portion directly connected to the exterior portion so the interior and exterior portions are at approximately the same DC potential, the interior portion being arranged so that a direct connection between said terminals of the first or second layers subsists through it, the interior portion being in close proximity to the magnetic core means and providing an electrostatic shield for currents having a tendency to flow between the windings.

25. The transformer of claim 24 wherein the interior portion comprises a finger with an open end.

26. The transformer of claim 24 wherein the interior portion comprises a loop including first and second segments with a gap between them.

27. The transformer of claim 26 wherein the terminals of said layers are in close proximity to each other and the gap is approximately diametrically opposite to the terminals of said layers, an electrical conductor extending from the first segment to one of the terminals of said layers via a path extending past both the gap and the second segment in a space between the second segment and the exterior portion.

28. The transformer of claim 27 wherein said first and second segments are joined so that only one gap subsists between them.

29. The transformer of claim 27 wherein said first and second segments are arranged so that first and second approximately diametrically opposed gaps subsist between them, the first gap being approximately diametrically opposed to the terminals, a second electrical conductor extending between the first and second segments via a path starting at the first segment and extending past the second gap, past the second segment in a space between the second segment and the exterior portion, through the first gap, and past the first segment in a space between the first segment and the magnetic core means.

30. The transformer of 16 wherein each of the first and second layers at opposite ends of the primary winding includes: a pair of spaced terminals, an exterior portion for conducting current between said terminals and an interior electrically conducting portion directly connected to the exterior portion so the interior and exterior portions are at approximately the same DC potential, the interior portion being arranged so that a direct connection between said terminals of the first or second layers subsists through it.

31. The transformer of claim 30 wherein the interior portion comprises a finger with an open end.

32. The transformer of claim 30 wherein the interior portion comprises a loop including first and second segments with a gap between them.

33. The transformer of claim 32 wherein the terminals of each layer are in close proximity to each other and the gap is approximately diametrically opposite to the terminals of said layer, an electrical conductor extending from the first segment to one of the terminals of said layer via a path extending past both the gap and the second segment in a space between the second segment and the exterior portion.

34. The transformer of claim 33 wherein said first and second segments are joined so that only one gap subsists between them.

35. The transformer of claim 33 wherein said first and second segments are arranged so that first and second approximately diametrically opposed gaps subsist between them, the first gap being approximately diametrically opposed to the terminals of said layer, a second electrical conductor extending between the first and second segments via a path starting at the first segment and extending past the second gap, past the second segment in a space between the second segment and the exterior portion, through the first gap, past and in close proximity to the first segment, and past the second gap.

36. A transformer comprising a primary winding and a secondary winding including first and second similar spaced parts, between which the primary winding is located, each of said windings including plural turns, the turns of each secondary winding part being connected in series and parallel, individual ones of said turns being formed by a printed circuit electrically conducting layer, said layers being (i) magnetically coupled to each other and (ii) stacked in mutually parallel planes, the primary winding including a shield turn positioned between a turn of the secondary winding in closest proximity thereto and all other turns of the primary winding, the shield turn including an exterior segment for conducting current supplied to the transformer between terminals of said layer forming the shield turn and an interior electrically conducting portion directly connected to the exterior portion so the interior and exterior portions are at approximately the same DC potential, the interior portion being arranged so that there is a direct connection between it and one of said terminals of the layer forming the shield turn, the interior portion being in close proximity to the magnetic core means and providing an electrostatic shield for currents having a tendency to flow between the windings.

37. The transformer of claim 36 wherein the interior portion comprises a finger with an open end.

38. The transformer of claim 36 wherein the interior portion comprises a loop including first and second segments with a gap between them.

39. The transformer of claim 38 wherein the terminals of said layers are in close proximity to each other and the gap is approximately diametrically opposite to the terminals of said layers, an electrical conductor extending from the first segment to one of the terminals of said layers via a path extending past both the gap and the second segment in a space between the second segment and the exterior portion.

40. The transformer of claim 39 wherein said first and second segments are arranged so that first and second approximately diametrically opposed gaps subsist between them, the first gap being approximately diametrically opposed to the terminals of said layer, a second electrical conductor extending between the first and second segments via a path starting at the first segment and extending past the second gap, past the second segment in a space between the second segment and the exterior portion, through the first gap, past and in close proximity to the first segment, and past the second gap.

* * * * *